United States Patent [19]

Kerzel et al.

[11] Patent Number: 5,039,232

[45] Date of Patent: Aug. 13, 1991

[54] OFFICE MACHINE INCLUDING A MULTICOLOR PLOTTING MECHANISM

[75] Inventors: Günter Kerzel, Schortens; Arthur Kittel, Wilhelmshaven, both of Fed. Rep. of Germany

[73] Assignee: AEG Olympia Office GmbH, Wilhelmshaven, Fed. Rep. of Germany

[21] Appl. No.: 542,074

[22] Filed: Jun. 22, 1990

[30] Foreign Application Priority Data

Jun. 22, 1989 [DE] Fed. Rep. of Germany ..... 3920373

[51] Int. Cl.[5] ..... B41G 3/00

[52] U.S. Cl. ..... 400/18; 346/139 C; 400/208; 400/695; 400/663

[58] Field of Search ..... 400/125, 16, 17, 18, 400/19, 208, 695, 663, 668; 346/139 C

[56] References Cited

U.S. PATENT DOCUMENTS

| | | | |
|---|---|---|---|
| 4,527,174 | 7/1985 | Fujiwara et al. | 346/139 C |
| 4,627,748 | 12/1986 | Mizuno et al. | 400/18 |
| 4,798,489 | 1/1989 | Shiota | 400/240 |
| 4,813,796 | 3/1989 | Kittel | 400/208 |
| 4,840,505 | 6/1989 | Kurokawa | 400/214 |
| 4,856,919 | 8/1989 | Takeuchi et al. | 400/125 |
| 4,884,907 | 12/1989 | Yascumi | 400/240 |

FOREIGN PATENT DOCUMENTS

| | | | |
|---|---|---|---|
| 0264595 | 4/1988 | European Pat. Off. | 400/18 |
| 0089966 | 6/1982 | Japan | 400/18 |

*Primary Examiner*—Eugene H. Eickholt
*Attorney, Agent, or Firm*—Spencer & Frank

[57] ABSTRACT

A typewriter includes a carriage arranged for reciprocating travel, a receiving arrangement mounted on the carriage, a drive arrangement mounted on the carriage, and a ribbon cartridge receivable in and removable from the receiving arrangement and operatively connectable with the drive arrangement, and an XY-plotter receivable and removable from the receiving arrangement when the ribbon cartridge is absent from the receiving arrangement. The XY-plotter includes a stylus holder for supporting a plurality of styli; a first force-transmitting arrangement operatively connectable to the drive arrangement for moving the stylus holder such as to place a selected stylus in a standby writing position; and a second force-transmitting arrangement operatively connectable to the drive arrangement for moving the selected stylus in contact with the record carrier.

11 Claims, 2 Drawing Sheets

219
217
205
203
207
211
215
91
95
179
183
175
166
164
165
171
87
169
213
85
167
29
177
173
181
19
7
147
145
143
185
187
191
153
199
155
161
201
163
93
195
197
151
189
193
97
149
139
141
137
135
133
131
123
127
125
119
111
121
209
159
157
114
129
115
117
99
103
113
89
101
107
105
109

OFFICE MACHINE INCLUDING A MULTICOLOR PLOTTING MECHANISM

CROSS REFERENCE TO RELATED APPLICATION

This application claims the priority of Federal Republic of Germany Application No. P 39 20 373.5 filed June 22nd, 1989, which is incorporated herein by reference.

BACKGROUND OF THE INVENTION

This invention relates to a printing office machine including an ink ribbon cartridge which may be readily attached to or removed from a receiving unit mounted on a printing carriage which is movable along a record carrier, such as paper. On the carriage there are arranged a printing head which produces an alphanumeric full-print character on the record carrier with the interposition of the ink ribbon and a drive mechanism for advancing the ink ribbon. The office machine further has a reversible drive motor for the forward and reverse feed of the record carrier.

Since typewriters are being used in ever-increasing frequency as output devices for computers, it is desirable to equip the typewriters with devices that are capable of color reproduction of graphs or graphics. The multicolor plotters of prior art constructions, however, have been very expensive; they have required significant space and therefore are not adapted optimally for use in the home for personal computers.

While line drawing devices (plotters) mounted on typewriters for producing horizontal or vertical lines are well known in many varieties, they are, however, not often encountered in practice. This fact indicates that their usefulness is still in question; one reason therefor may be their drawback that they have been obstructing the normal printing process to an excessive extent.

German Patent No. 891,271 discloses a threaded holding sleeve mounted by a clip to the left or to the right on the plastic line plate next to the character guide head for receiving a threaded ballpoint pen cartridge. Such an arrangement interferes with the normal typing operation particularly in machines in which the printing head is mounted on a carriage which is movable along the record carrier. Also, a replacement of the ballpoint pen cartridges requires particular skill on the part of the machine operator.

Further, German Offenlegungsschrift (application published without examination) 3,315,733 discloses a multicolor plotter which has styli of different color arranged on the periphery of a drum-like holder. The setting of the plotter to the desired color is, however, very complex. In addition, German Offenlegungsschrift 3,619,567 to which corresponds U.S. Pat. No. 4,813,796 describes a shifting element provided with a stylus which, by means of a manually operable device mounted on the shifting element, may be set from an inoperative position to a ready-to-write position. While this plotter permits the drawing of simple lines in a horizontal, vertical or any other direction, the setting of the shifting element must be effected manually. For this reason, the device is not adapted for an automatically operating printer.

German Patent No. 3,140,888 discloses a plotter which has writing elements shiftable in the direction of the record carrier. The writing elements are colored styli and are arranged in a drum-shaped holder. While this multicolor plotter is adapted to produce graphic patterns in color, it is not readily adaptable to a simple typewriter.

It is further noted that no carbon copies can be produced with the above-outlined known drawing devices.

SUMMARY OF THE INVENTION

It is an object of the invention to provide an improved office machine of the above-outlined type whose plotter for producing colored patterns is formed of simple components, is easily installed and, in particular, is well adapted for inexpensive, mass-produced machines.

This object and others to become apparent as the specification progresses, are accomplished by the invention, according to which, briefly stated, the receiving arrangement provided on the printing head supporting carriage is so constructed that selectively an ink ribbon or an XY-plotter with colored styli may be inserted. The colored styli are selectable by the ribbon advancing mechanism and may be brought into contact with the record carrier by a driving device which moves the selected stylus from a withdrawn (detent) position into a working position.

Thus, according to the invention, the plotter for producing colored patterns may be installed in the typewriter instead of the ink ribbon. Since all typewriters already in consumer service may be retrofitted with the plotter according to the invention, the plotter may be purchased either simultaneously with the typewriter or at any time subsequent to the purchase of the machine as an independently operable module. It is a further advantage of the invention that for driving the plotter, a drive mechanism is used which is, in any event, part of the typewriter for performing different functions as well.

DESCRIPTION OF THE PREFERRED EMBODIMENT

Figure 1:
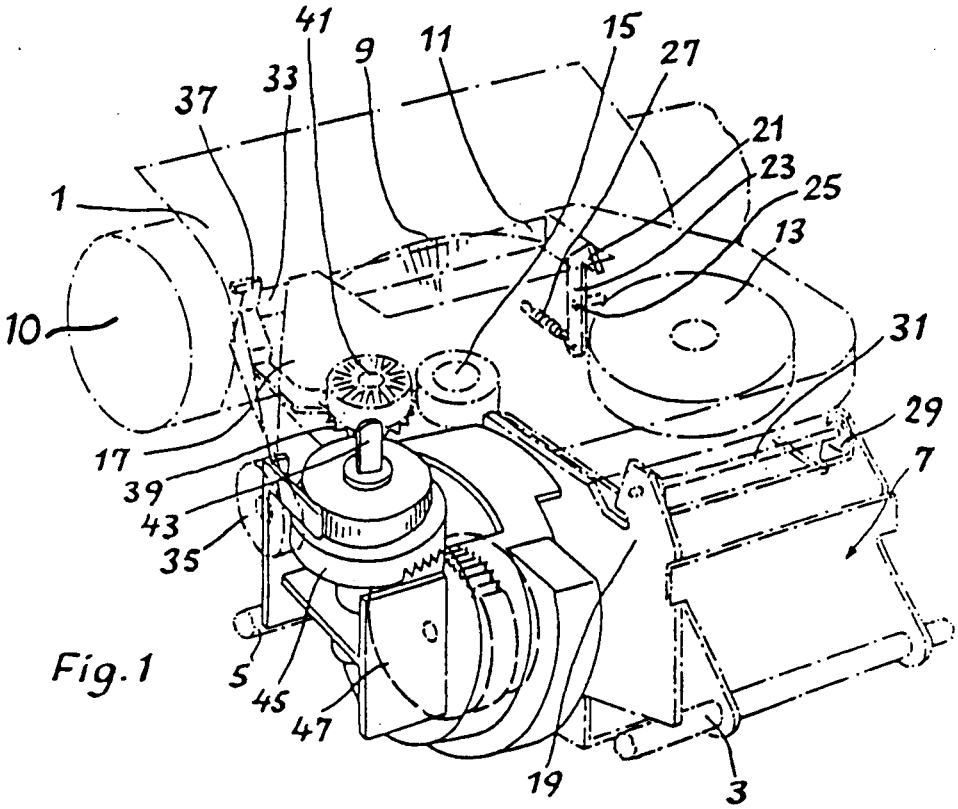
FIG. 1 is a schematic perspective view of a travelling printing mechanism in a typewriter adapted to incorporate the invention.

Turning to FIG. 1, there is shown therein a character carrier carriage 7 which is movable on parallel shafts 3 and 5 across a record carrier 1 parallel thereto. The record carrier 1 is supported on a platen 10. Next to a character carrier 9 there is arranged a driving device for advancing an ink ribbon 11 in a typewriter or similar office machine. The ribbon which is guided from a supply reel 13 to a take-up reel 15 is accommodated in a cartridge 17 which may be inserted on or removed from a receiving device 19 provided on the printing carriage 7. The ribbon cartridge 17 is, on its side facing the record carrier 1, lockable by a detent hook 21 of a locking pawl 23 pivotally mounted in the receiving device 19. The pawl 23 is pivotal about a pin 25 and is biased into the locking position by a spring 27. Underneath the inserted ribbon cartridge 17 there is arranged a carrier plate 29 which is pivotal about a supporting shaft 31 and on which there are arranged receiving reels for a correcting ribbon 33. For sake of clarity, only the supply reel 35 of the correcting ribbon is shown. The correcting ribbon 33 taken from the supply reel 35 is deflected in a known manner about a deflecting guide 37 which is a component of the pivotal carrier plate 29. The take-up reel for the correcting ribbon 33 and the corresponding driving device are not shown or described in detail.

Figure 2:
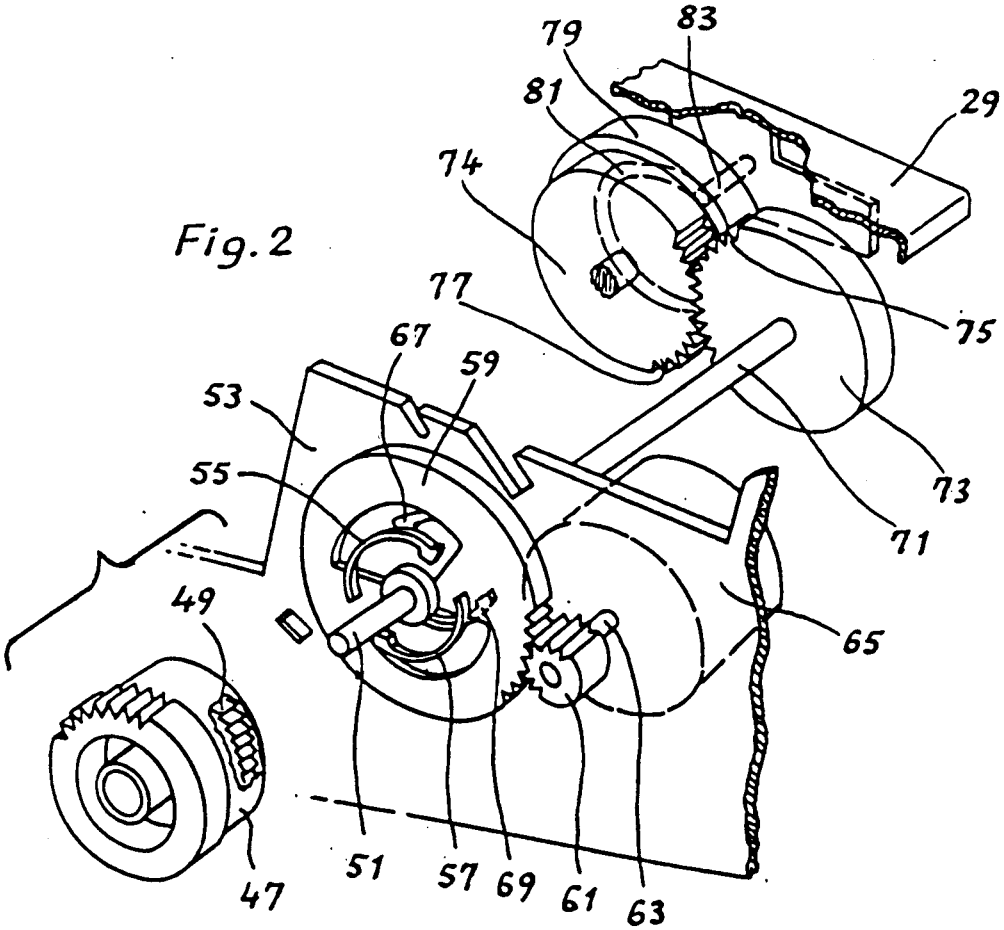
FIG. 2 is a perspective schematic detail of FIG. 1.

The take-up reel 15 for the ink ribbon 11 is driven by a spiked wheel 39 which has a manual setting wheel 41 and a cross-shaped recess for receiving a knife edge-shaped coupling element 43 mounted in the receiving device 19 of the printing carriage 7. The coupling element 43 is resiliently supported for movement in an axial direction and is driven by a gear 45 which continuously meshes with a gear 47. The latter, as seen in FIG. 2, is supported on a stub shaft 51 at a side wall 53 of the printing carriage 7 for rotation and has teeth 49 which may be engaged by torque-transmitting pawls 55, 57 when a drive gear 59, which carries the pawls 55, 57 and which is also supported on stub shaft 51, is rotated in a predetermined direction. The drive gear 59 is driven by a pinion 61 which is fixedly connected with the drive shaft 63 of a drive motor 65.

The drive wheel 59 has at its reverse side torque-transmitting pawls 67, 69 which, upon a reversal of the rotary direction of the drive motor 65 drive a drive shaft 71 whose free end carries a fixedly attached gear 73. The teeth 75 of the gear 73 continuously mesh with the teeth 77 of a gear 74 which is fixedly attached to a cam disc 79. The cam disc 79 has a cam track 81 into which extends a follower pin 83 of the pivotal carrier plate 29. When the gear 74 is driven together with the cam disc 79, a pivotal motion of the carrier plate 29 with the correcting device occurs.

Figures 3, 4:
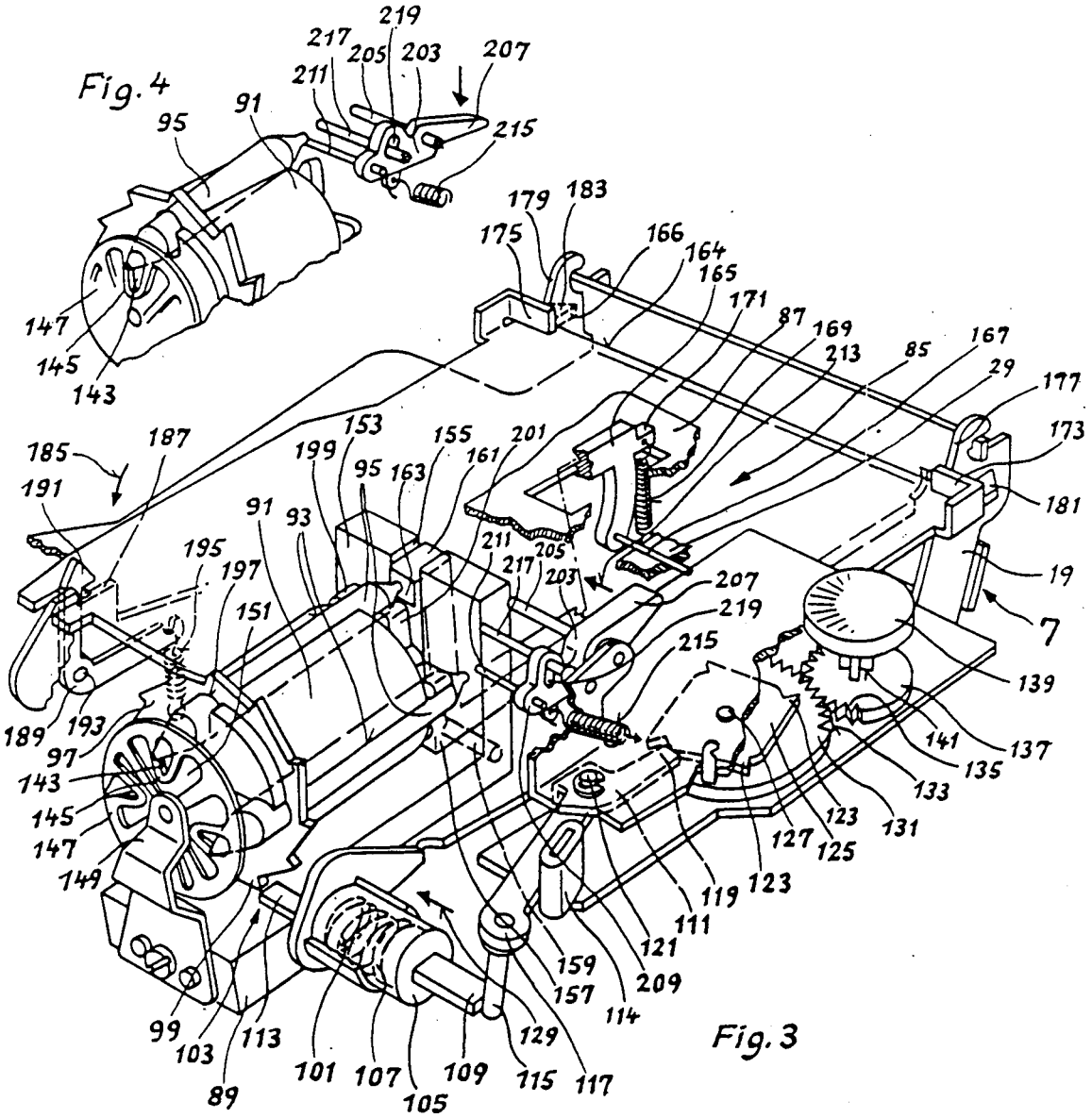
FIG. 3 is a schematic perspective view of a preferred embodiment of the invention.
FIG. 4 is a schematic perspective view of a detail of FIG. 3

In FIGS. 3 and 4 an XY-plotter 85 is illustrated which may be inserted into the receiving device 19 of the printing carriage 7 instead of the ink ribbon 17. The plotter 85 has a support plate 87 which may be securably supported on the receiving device 19 and which has a support block 89 which, in turn, rotatably supports a drum 91 having axially oriented, circumferentially arranged troughs 93. Styli 95 are receivable in the respective troughs 93 and may be immobilized therein. The styli, as will be described later, are shiftable axially towards the record carrier 1. The drum 91 is driven by a pawl drive—which may be coupled with the ribbon advancing device—for placing a selected one of the styli in a standby position. For this purpose the drum 91 is provided with a ratchet wheel 97 whose teeth 99 may be brought into engagement with a drive pawl unit 103 which is formed of a piston 107 shiftable in a hollow cylinder 105 against the force of a spring 101. The piston 107 has an abutment pin 109 which projects from one end from the hollow cylinder 105, for being engaged by a drive pin 115 of a drive lever 111 and is at its other end provided with a leaf spring 113 which is shiftably supported in a slot of the hollow cylinder 105 and which, with its free end, may engage between the teeth 99 of the ratchet wheel 97. The spring biased pawl unit 103 presses, in its initial position, the drive lever 111 against a stationary stop 114.

The drive pin 115 is fixedly attached to a first arm 117 of the drive lever 111. A second arm 119 which is pivotal about a pin 121 is engageable by projecting cams 123 of a cam disc 125 rotatable about a support pin 127 in such a manner that the drive lever 111 is lifted off the stop 114 and the driving pawl unit 103 engages the ratchet 97 for causing the drum 91 to perform a setting step in the direction of the arrow 129. Since the cam disc 125 is provided with four abutment cams 123, the drive lever 111 is, during one full revolution of the cam disc 125, engaged four times. The cam disc 125 is fixedly connected with a gear 131 whose teeth 133 mesh with the teeth 135 of a drive gear 137. The drive gear 137 is rotatably supported in the support plate 87 and is connected with a manually engageable knob 139. Furthermore, the drive gear 137 has at least at its underside a cross-shaped recess 141 which, upon inserting the support plate 87 on the receiving device 19 of the printing carriage 7, is coupled with the knife edge-shaped coupling element 43 of the typewriter. The setting motion of the drum 91 together with the longitudinally displaceable styli 95 may thus be effected either by rotating the manually engageable knob 139 or by means of the ink ribbon advancing mechanism with the coupling element 43 in such a manner that a selected colored stylus 95 is brought into the working position depicted in FIG. 3.

The free ends of the styli 95 disposed in the receiving troughs 93 of the drum 91, oriented towards the record carrier 1 project from the openings 143 of resilient tabs 145 of a spring disc 147 which is rotatably supported on an arm 149 of the support block 89. The resilient tabs 145 are formed by recesses 151 provided in the spring discs 147 and engage the styli 95 in such a manner that the latter, with their ends remote from the writing ends, engage a stop face 153 of the support block 89. The stop face 153 has an opening 155 in which there is pivotally supported a two-armed pressing lever 157 which is pivotal about a pin 159 and has, at one arm 161, a pressing face 163 for engaging the styli 95 while the other arm 165 has an abutment pin 167 for the carrier plate 29 which accommodates the correcting device. The pressing lever 157 is, in its position of rest, retained in engagement with the upper face of the carrier plate 87 by means of a spring 169 with an abutment lug 171.

Upon inserting the support plate 87, carrying the plotter 85 in the receiving device 19 of the printing carriage 7, the support plate 87 is, with an engagement edge 164 inserted into slots of the side wall of the printing carriage 7. The extent of such an insertion is limited by an abutment of the lugs 173, 175 against the projecting stops 177, 179 on the side walls of the printing carriage 7. The lateral immobilization of the support plate 87 is effected by lateral abutment lugs 181, 183 which engage the outer faces of the side walls of the printing carriage 7. The support plate 87 is pivotal about the plug-in connection in the direction of the arrow 185 until the support plate 87 with its underside contacts the engagement faces 187, whereupon a locking pawl 189, by means of a locking lug 191 locks the support plate 87. The locking pawl 189 is pivotally supported on a pin 193 against the force of a spring 195. The locking pawl 189 also serves as an immobilizing mechanism for the ribbon cartridge 17 after insertion thereof in the receiving device 19 of the printer carriage 7.

The styli 95 are securely held in the troughs 93 of the drum 91 by the bore holes 197 provided in the ratchet wheel 97 and by resilient holding clips 199 and 201. In order to facilitate replacement of the styli 95 which are designed as ballpoint pen cartridges, on the support plate 87 an unlocking device for the styli 95 is provided. For this purpose a release lever 203 is rotatably and shiftably supported on a shaft 205. The release lever 203 has a manually operable first arm 207 and a second arm 209 which has an abutment pin 211. The latter is, by means of shifting the release lever 203 shiftable in the direction 213 underneath the free ends of the styli 95, whereupon by pivoting the release lever 203 in the clockwise direction the styli 95 are automatically released from the holding clips 199, 201. The resetting of the release lever 203 is effected by a spring 215 which is supported in such a manner that the release lever 203 may be turned counterclockwise and also may be shifted on the shaft 205 into its initial position. The pivotal motion of the release lever 203 is limited by a stop pin 217 which extends into a slot 219 of the release lever 203.

If colored graphs, patterns or lines are to be produced, in full-print on the record carrier 1, the operating person simply removes the ink ribbon cartridge 17, the printer (daisy wheel) and the correcting ribbon from the receiving device 19 of the printing carriage 7 and inserts instead the plotter 85 and secures the support plate 87 in the receiving device 19 as described earlier. Thereafter the desired colored stylus 95 in the drum 91 is selected and is brought, by manually rotating the knob 139 or by energizing the drive motor 65 by depressing a key (not shown), into the working position as shown in FIG. 3. The rear terminus of the stylus 95 selected for printing is brought in front of the pressing face 163 of the pressing lever 157. The torque transmission of the drive gear 137 to the gear 133 causes a counterclockwise rotary motion of the cam disc 125, whereby the driving lever 111 is pivoted in the clockwise direction, causing the leaf spring 113 of the driving pawl unit 103 to be shifted in the direction of the arrow 129. The ratchet wheel 97 is engaged and stepwise rotated—together with the drum 91—by the pawl unit 103, until the desired stylus 95 is brought into the working position. Thereafter, the pressing lever 157 is pivoted counterclockwise about the support shaft 159 until the stylus 95, with its writing point, engages the record carrier 1. The pivotal motion of the pressing lever 157 is caused by the pivot plate 29 which engages the abutment pin 167 at the pressing lever 157. The positioning of the stylus 95 is thus effected by the pivotal plate 29 which, for serving the correcting device, is present in the typewriter in any event. The pivotal motion of the pivot plate 29 is effected by the drive motor 65 which is opposite the direction of rotation for the ribbon advance. The coupling pawls 67, 69 transmit a torque to the drive shaft 71 which then, by the intermediary of gears 73 and 74, rotates the cam disc 79 provided with the cam track 81. By virtue of the rotary motion of the cam track 81 the guide pin 83 engages the pivotal plate 29 for causing pivotal motion thereof.

The device according to the invention makes it possible with the simplest means to produce full-print and/or colored representations and graphic drawings or patterns by simply replacing the ink ribbon 17 by the plotter 85 that holds the colored styli 95. Thus, the plotter 85 may be installed retroactively in machines marketed earlier.

It will be understood that the above description of the present invention is susceptible to various modifications, changes and adaptations, and the same are intended to be comprehended within the meaning and range of equivalents of the appended claims.

What is claimed is:

1. In a typewriter including support means for positioning a record carrier, a carriage arranged for reciprocating travel, receiving means mounted on the carriage, drive means mounted on the carriage, and a ribbon cartridge receivable in and removable from said receiving means and operatively connectable with said drive means when seated in said receiving means, the improvement comprising an XY-plotter receivable and removable from said receiving means when said ribbon cartridge is absent from said receiving means; said XY-plotter including stylus holding means for supporting a plurality of styli;

first force-transmitting means operatively connectable to said drive means when said XY-plotter is seated in said receiving means for moving said stylus holding means such as to place a selected stylus in a standby writing position; and second force-transmitting means operatively connectable to said drive means when said XY-plotter is seated in said receiving means for moving the selected stylus in contact with the record carrier positioned by said support means.

2. A typewriter as defined in claim 1, further wherein said XY-plotter comprises a support plate and a support block affixed to said support plate; further comprising releasable immobilizing means mounted on said carriage for immovably securing said support plate in said receiving means; said stylus holding means comprises a drum having a rotary axis; said drum having means defining an array of circumferentially arranged receiving troughs each adapted to hold a stylus in a radially captive and in an axially shiftable manner; said first force-transmitting means comprises a pawl drive arranged for operatively connecting said drive means with said drum.

3. A typewriter as defined in claim 2, wherein said drive means comprises a drive motor and a coupling element rotated by said drive motor; further comprising a ratchet wheel coaxially affixed to said drum and having a series of teeth; said pawl drive having a back-and-forth movable pawl to sequentially engage said teeth to intermittently rotate said drum, an abutment pin connected to said pawl and a spring urging the pawl and the abutment pin away from the teeth of the ratchet wheel; further comprising a cam disc operatively connected with said coupling element for being driven by said drive motor; and a pivotally supported drive lever having an end connected with said cam disc; said drive lever having another end connected with said abutment pin, whereby said back-and-forth movable pawl executes alternating forward strokes and return strokes upon rotation of said cam disc.

4. A typewriter as defined in claim 3, further comprising manually rotatable means connected to said cam disc for imparting manually transmitted rotations thereto independently from said drive motor.

5. A typewriter as defined in claim 3, further comprising a stop affixed to said support plate, said drive lever being urged against said stop by said spring through said abutment pin.

6. A typewriter as defined in claim 3, wherein said pawl drive further comprises a hollow cylinder, a piston slidably supported in said cylinder and affixed to said abutment pin; said spring exerting a spring force on said piston.

7. A typewriter as defined in claim 6, further comprising a resilient disc rotatably mounted on said block at an end of said drum; said resilient disc being oriented radially to the rotary axis of the drum and having axially resilient tabs provided with apertures aligned with respective said troughs of the drum, whereby styli supported in the troughs project, with a front end thereof, through the apertures; said tabs being arranged to urge the styli in a direction away from the record carrier held in said support means; further comprising an abutment plate secured to said support block at an end of said drum remote from said resilient disc; said resilient disc pressing the styli against said abutment plate; said abutment plate having an aperture aligned with said selected stylus situated in said standby writing position; further comprising a two-armed pressing lever pivotally supported by said block such that said two-armed pressing lever is adapted to swing into said aperture and push the selected stylus into contact with the record carrier; said two-armed pressing lever forming part of said second force-transmitting means; said two-armed pressing lever being operatively connected with said drive means.

8. A typewriter as defined in claim 7, further comprising a pivotal plate mounted on said carriage and being operatively connected to said drive means for lifting a correcting tape upon actuation; said two-armed pressing lever being in operative connection with said pivotal plate for moving the two-armed pressing lever into contact with the selected stylus upon an actuation of said pivotal plate.

9. A typewriter as defined in claim 7, wherein said ratchet has apertures aligned with said troughs to allow the styli to pass therethrough; further comprising resilient clips arranged at an end of said drum remote from said ratchet for immobilizing the styli in said troughs.

10. A typewriter as defined in claim 9, further comprising a release lever supported on said support plate adjacent said two-armed pressing lever for cooperating with said holding clips to release the styli from the holding clips.

11. A typewriter as defined in claim 10, further comprising a pivot shaft held in said support plate, said release lever being shiftably and rotatably supported on said pivot shaft; said release lever having a manually engageable first arm and a second arm provided with a stop pin; said stop pin, upon manipulation of said first arm, being slidable past a free end of the styli and rotatable for releasing the styli; further comprising spring means attached to said release lever for opposing manipulating forces exerted on said first arm.

* * * * *